US008985093B2

(12) United States Patent
Ingersoll

(10) Patent No.: US 8,985,093 B2
(45) Date of Patent: Mar. 24, 2015

(54) DOMESTIC COOKING APPLIANCE HAVING SIDE WALL TRIM MOUNTING

(71) Applicant: BSH Home Appliances Corporation, Irvine, CA (US)

(72) Inventor: Tiffany E. Ingersoll, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 280 days.

(21) Appl. No.: 13/705,218

(22) Filed: Dec. 5, 2012

(65) Prior Publication Data

US 2014/0150768 A1 Jun. 5, 2014

(51) Int. Cl.
*F24C 15/00* (2006.01)
*F24C 15/08* (2006.01)

(52) U.S. Cl.
CPC ..... *F24C 15/08* (2013.01)
USPC ..... 126/50; 126/273 R; 126/19 R

(58) Field of Classification Search
USPC ..... 126/50, 273 R, 19 R, 190; 312/401, 409; 52/508, 511
See application file for complete search history.

(56) References Cited

U.S. PATENT DOCUMENTS

| | | | |
|---|---|---|---|
| 3,142,295 | A | 7/1964 | Blee |
| 3,169,518 | A | 2/1965 | Scott |
| 3,392,720 | A | 7/1968 | Sherman |
| 3,473,858 | A | 10/1969 | Barnett |
| 3,766,700 | A | 10/1973 | Nuss |
| 3,782,360 | A | 1/1974 | Brucken |
| 5,881,710 | A | 3/1999 | Davis et al. |
| 7,665,810 | B2 | 2/2010 | Crompton et al. |
| 8,020,949 | B2 | 9/2011 | Davis et al. |
| 2006/0103282 | A1 | 5/2006 | Avendano et al. |

*Primary Examiner* — Alfred Basichas
(74) *Attorney, Agent, or Firm* — James E. Howard; Andre Pallapies

(57) ABSTRACT

A domestic cooking appliance having a side trim panel system. The appliance includes a mounting bracket attached to the appliance, the mounting bracket being of a universal configuration such that it can be attached to either the left or right side of the appliance outside of a zone adjacent to a cooking space; and a side trim panel that attaches to the mounting bracket and the appliance, the side trim panel being of a universal configuration such that it can be attached to the mounting bracket and the appliance when the first mounting bracket is attached to either the left or right side of the appliance. The side trim panel attaches to the mounting bracket by a friction fit, and where the side trim panel attaches directly to the appliance, it only attaches to the appliance outside of the zone.

20 Claims, 9 Drawing Sheets

DOMESTIC COOKING APPLIANCE HAVING SIDE WALL TRIM MOUNTING

FIELD OF THE INVENTION

The invention is directed to a domestic cooking appliance having side walls.

An example of an application for the invention is a domestic cooking appliance having side wall trim panels and the mounting system of the side wall trim panels.

BACKGROUND OF THE INVENTION

Some conventional domestic cooking ranges can include a side wall trim. The side wall trim is positioned toward the front of the range along both the left and right sides. The side wall trim extends substantially the entire vertical height of the range, but only extends a few inches backward from the front of the range. A purpose of the side wall trim is to present a clean appearance to any portion that may extend forward beyond any cabinetry that is positioned on either side of the range. Thus, there is no need for the side wall trim to extend all the way to the rear of the range.

Some side wall trim arrangements involve screws or other mounting fasteners that extend through the side wall trim and into holes in an area of the chassis of the range that is adjacent to the cooking space inside the range (hereinafter referred to as the "zone adjacent to the cooking space"). Such fastening systems can be unsightly.

As a result of the above, there is a need for a way to mount side wall trim that is esthetically pleasing, is compact in size, and that attaches to a domestic cooking appliance without using fasteners that pierce the side wall of the zone adjacent to the cooking space of the domestic cooking appliance. A further benefit of reduced manufacturing and inventory costs can be achieved by making the parts of the side wall trim system universal so that the same part can be used on both sides of the appliance.

SUMMARY

The invention achieves the benefit of providing a side wall trim system that is esthetically pleasing, is compact in size, and that attaches to a domestic cooking appliance without using fasteners that pierce the side wall of the zone adjacent to the cooking space of the domestic cooking appliance. The invention also recognizes the benefit of reduced manufacturing and inventory costs by making the parts of the side wall trim system universal so that the same part can be used on both sides of the appliance.

Embodiments of the invention attach the side wall trim to a first bracket that is fastened to the appliance near the front of the appliance by fasteners that are outside of the zone adjacent to the cooking space. The rearmost part of the side wall trim can be attached to the appliance by way of a second bracket or directly to the appliance. In either case, the fasteners that attach the rearmost part of the side wall trim to the appliance are outside of the zone adjacent to the cooking space. The side wall trim is preferably attached to the appliance at both the top and bottom of the rearmost part so that the side wall trim is securely attached to the appliance. If the top of the rearmost part is not secured to the appliance, it can become scratched, bent, or otherwise damaged when the appliance is installed next to cabinetry.

Particular embodiments of the invention are directed to a domestic cooking appliance. The domestic cooking appliance includes a cooking space for cooking a food item; a left side, a right side, a front and a back, the left and right sides of the domestic cooking appliance having a zone adjacent to the cooking space which is horizontally next to the cooking space; a heating device for heating the cooking space; a door for closing off the cooking space; a left side first mounting bracket attached to the left side of the domestic cooking appliance outside of the zone adjacent to the cooking space; a left side trim panel attached to the left side first mounting bracket and the left side of the domestic cooking appliance, the left side trim panel attaching to the left side first mounting bracket by a friction fit; a right side first mounting bracket attached to the right side of the domestic cooking appliance outside of the zone adjacent to the cooking space; and a right side trim panel attached to the right side first mounting bracket and the right side of the domestic cooking appliance, the right side trim panel attaching to the right side first mounting bracket by a friction fit. Where the left side trim panel attaches directly to the domestic cooking appliance, it only attaches to the domestic cooking appliance outside of the zone adjacent to the cooking space. Where the right side trim panel attaches directly to the domestic cooking appliance, it only attaches to the domestic cooking appliance outside of the zone adjacent to the cooking space. The left side first mounting bracket and the right side first mounting bracket are identical, and the left side trim panel and the right side trim panel are identical.

Other embodiments of the invention are directed to a side trim panel system for a domestic cooking appliance having a cooking space, a left side, a right side, a front and a back, the left and right sides of the domestic cooking appliance having a zone adjacent to the cooking space which is horizontally next to the cooking space. The system includes a first mounting bracket configured to attach to the domestic cooking appliance, the first mounting bracket being of a universal configuration such that it can be attached to either the left side of the domestic cooking appliance or the right side of the domestic cooking appliance outside of the zone adjacent to the cooking space; and a side trim panel that attaches to the first mounting bracket and the domestic cooking appliance, the side trim panel being of a universal configuration such that it can be attached to the first mounting bracket and the domestic cooking appliance when the first mounting bracket is attached to either the left side of the domestic cooking appliance or the right side of the domestic cooking appliance. The side trim panel attaches to the first mounting bracket by a friction fit, and where the side trim panel attaches directly to the domestic cooking appliance, it only attaches to the domestic cooking appliance outside of the zone adjacent to the cooking space.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As stated above, some conventional domestic cooking ranges can include a side wall trim. The side wall trim is positioned toward the front of the range along both the left and right sides. The side wall trim extends substantially the entire vertical height of the range, but only extends a few inches backward from the front of the range. A purpose of the side wall trim is to present a clean appearance to any portion that may extend forward beyond any cabinetry that is positioned on either side of the range. Thus, there is no need for the side wall trim to extend all the way to the rear of the range.

The screws or other mounting fasteners that some side wall trim arrangements use extend through the side wall trim and into holes in the chassis of the range and can be unsightly.

Embodiments of the invention provide a side wall trim system that is esthetically pleasing, is compact in size, and that attaches to a domestic cooking appliance without using fasteners that pierce the side wall of the zone adjacent to the cooking space of the domestic cooking appliance. The added benefits of reduced manufacturing and inventory costs are realized by making the parts of the side wall trim system universal so that the same part can be used on both sides of the appliance.

Figure 1:
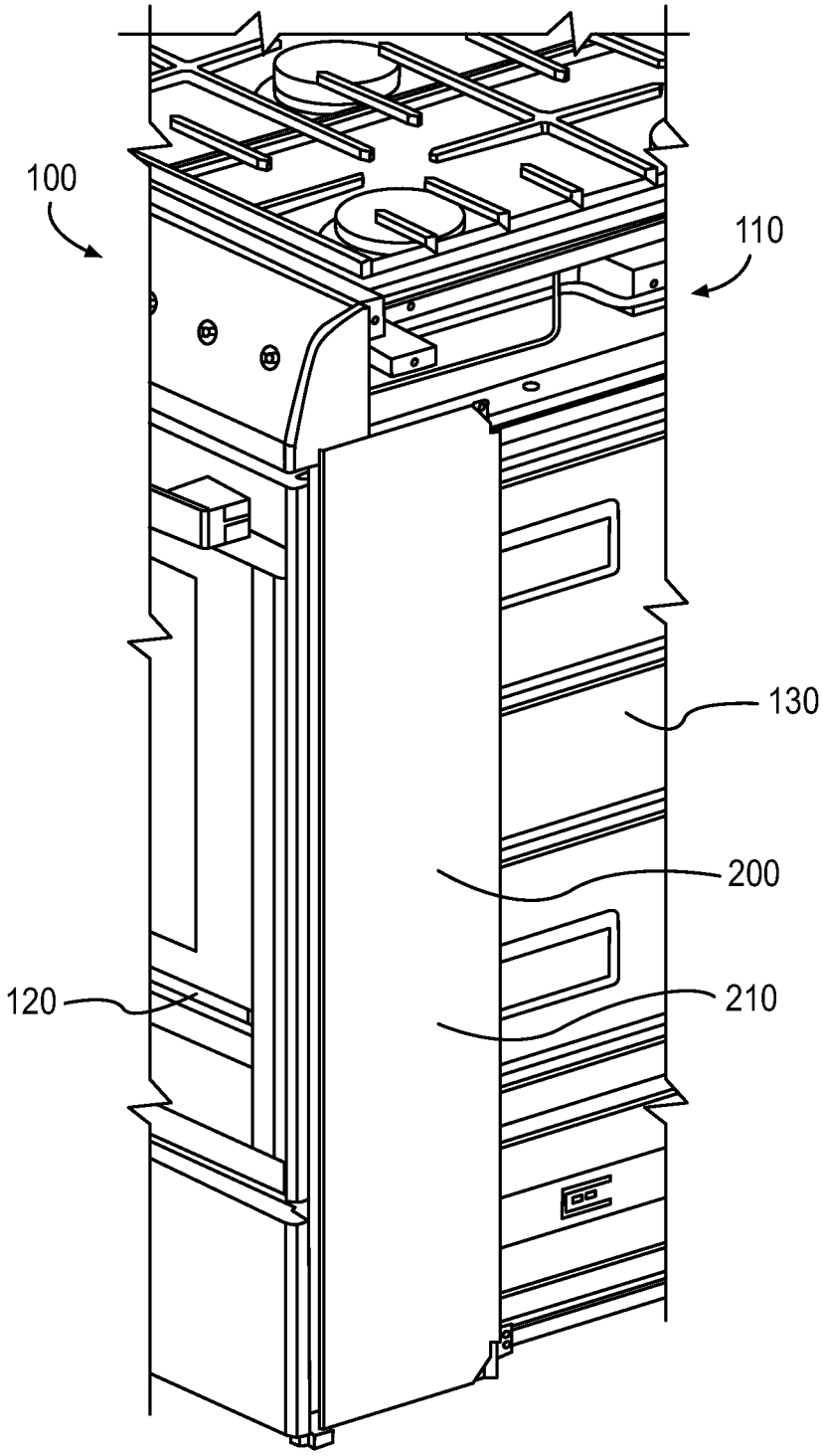
FIG. 1 is a partial perspective view of a domestic cooking appliance in accordance with exemplary embodiments of the invention.

FIG. 1 shows a partial view of an example of an appliance 100 in accordance with particular embodiments of the invention. Appliance 100 has a body 110 and a door 120. A side of appliance 100 is indicated by reference number 130. Shown partially covering side 130 is a side wall trim 200. This example of side wall trim 200 is a piece of bent sheet metal having a substantially flat surface 210. Side wall trim 200 covers only a portion of side 130 near the front of appliance 100. A purpose of side wall trim 200 is to present a more aesthetically pleasing appearance to the side of appliance 100 near the front of appliance 100 in cases where this portion of appliance 100 may protrude from cabinetry adjacent to appliance 100.

Figure 2:
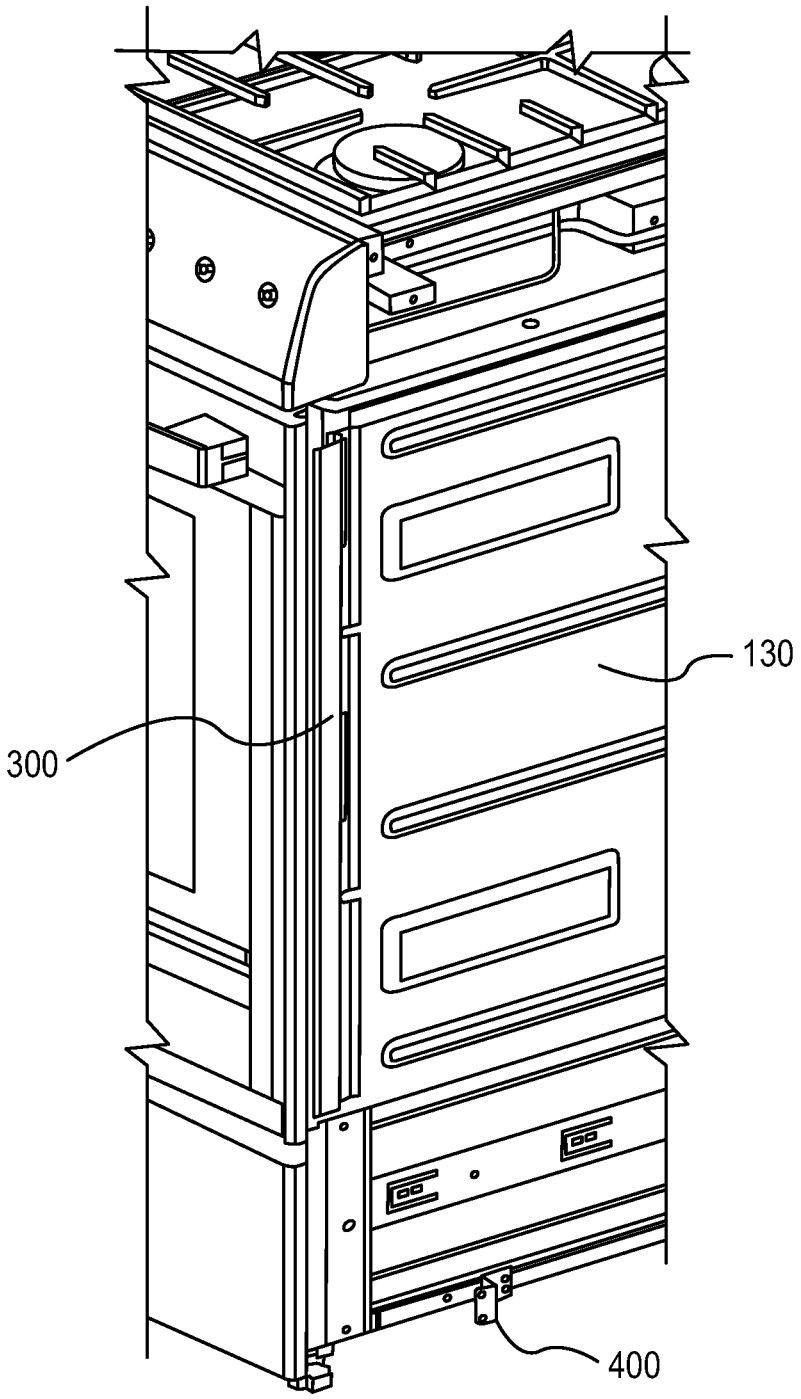
FIG. 2 is a partial perspective view of the domestic cooking appliance shown in FIG. 1, with the side trim panel removed.

FIG. 2 shows side 130 of appliance 100 with side wall trim 200 removed so that, in this example, two mounting brackets used to mount side wall trim 200 to appliance 100 can be seen. A large mounting bracket 300 is, in this example, attached to side 130 with, for example, screws, rivets or other fasteners outside and in front of the zone adjacent to the cooking space. A small mounting bracket 400 is located, in this example, near the bottom of appliance 100 and is attached to appliance 100 with, for example, screws, rivets, or other fasteners outside of the zone adjacent to the cooking space. Preferably, large mounting bracket 300 and small mounting bracket 400 would be attached at the factory when appliance 100 is manufactured. As a result, the use of screws, rivets or other fasteners is more acceptable because conditions at the factory are controlled, unlike the point of installation where an installer may incorrectly install the mounting brackets. In any event, the fasteners used to attach large mounting bracket 300 and small mounting bracket 400 to the appliance are outside the zone adjacent to the cooking space. This arrangement avoids the necessity for an installer to install any screws or other fasteners into side 130 of appliance 100 in the zone adjacent to the cooking space.

Figure 3:
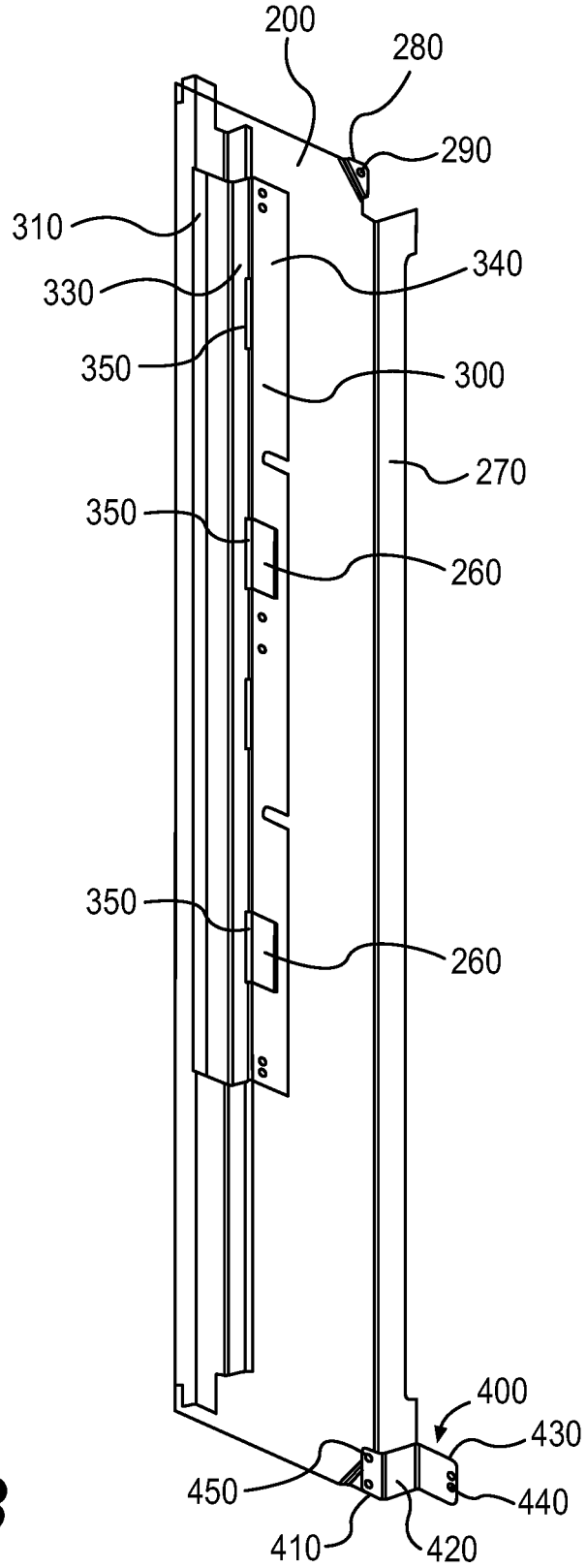
FIG. 3 is a perspective view of an exemplary side trim panel in accordance with embodiments of the invention.
Figure 4:
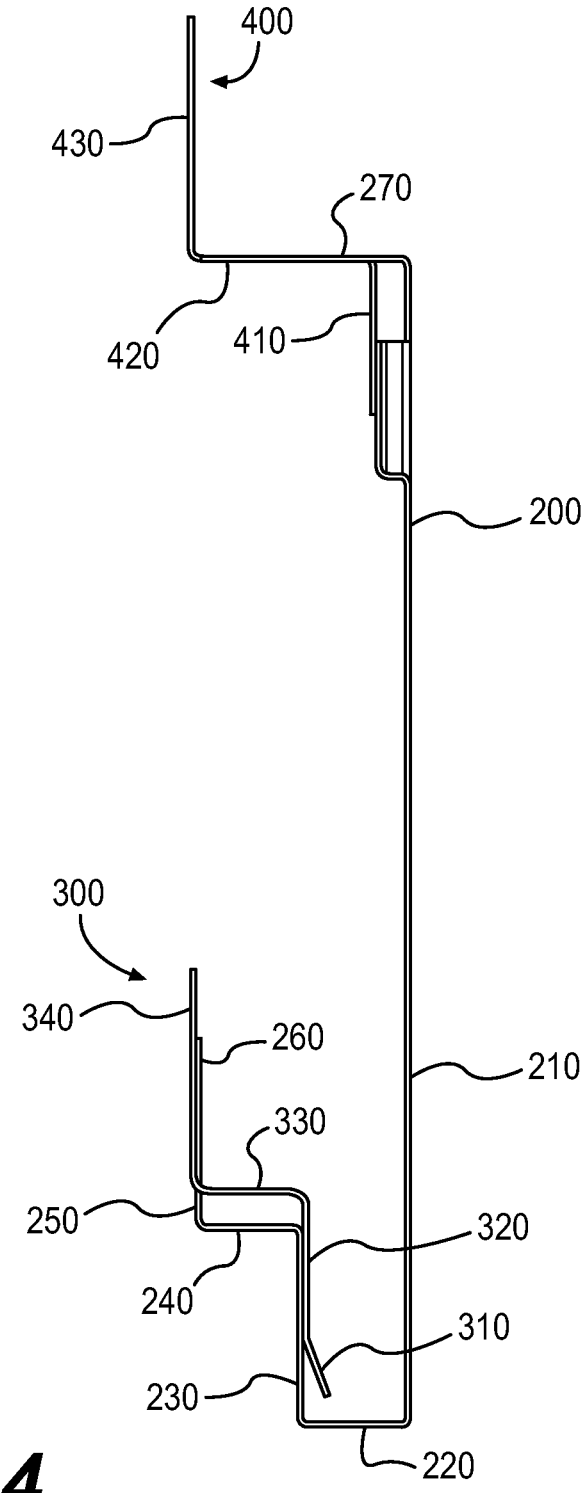
FIG. 4 is a top view of an exemplary embodiment of the invention.
Figure 5:
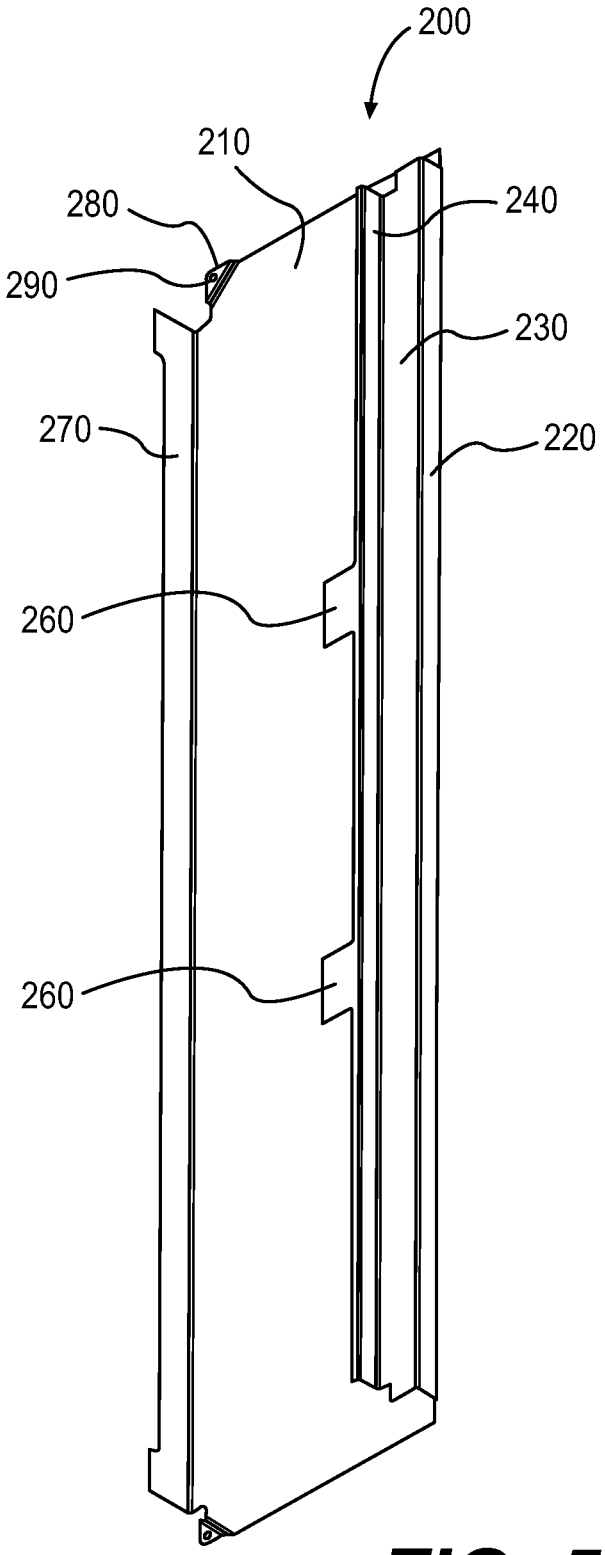
FIG. 5 is a perspective view of an exemplary side trim panel in accordance with embodiments of the invention.
Figure 6:
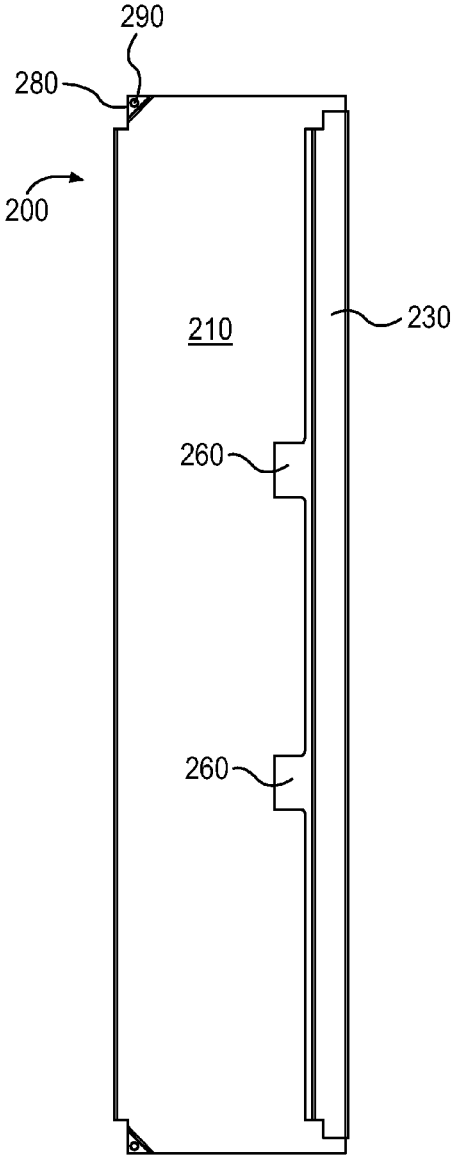
FIG. 6 is an inside view an exemplary side trim panel in accordance with embodiments of the invention.
Figure 7:
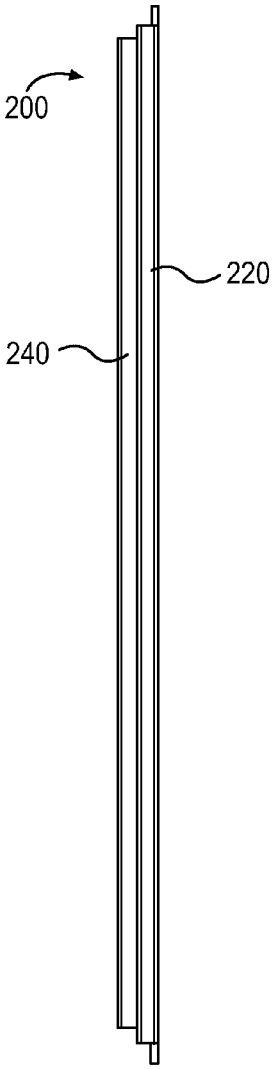
FIG. 7 is a front view an exemplary side trim panel in accordance with embodiments of the invention.
Figure 8:
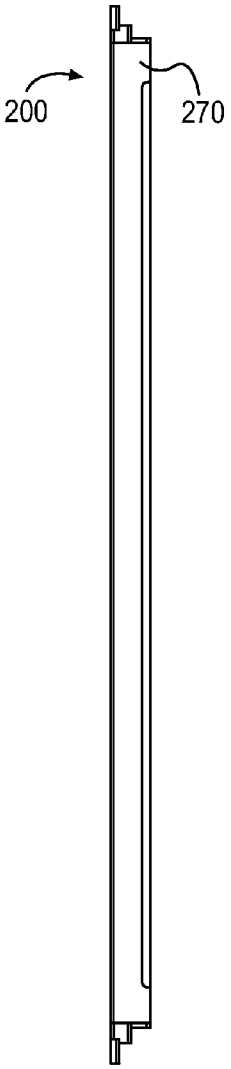
FIG. 8 is a rear view of an exemplary side trim panel in accordance with embodiments of the invention.
Figure 9:
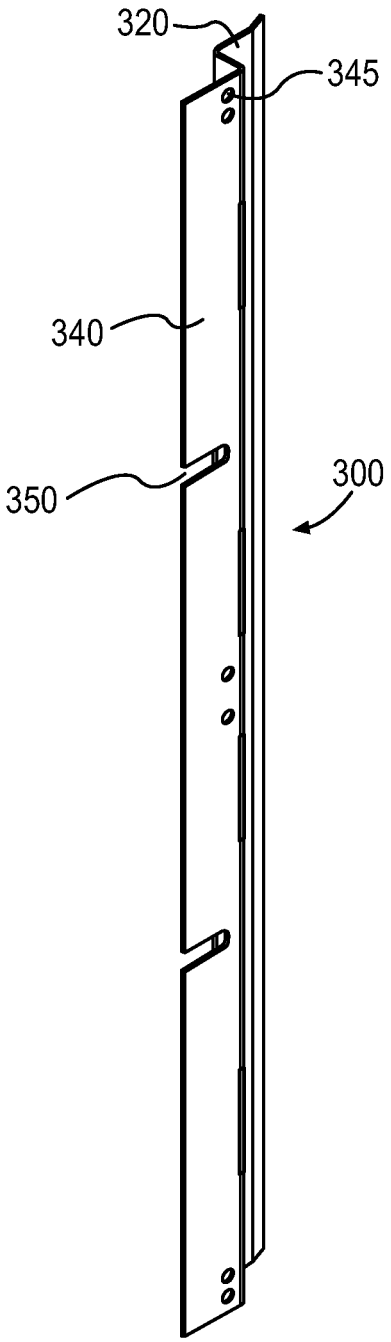
FIG. 9 is a perspective view of an exemplary first mounting bracket in accordance with embodiments of the invention.
Figure 10:
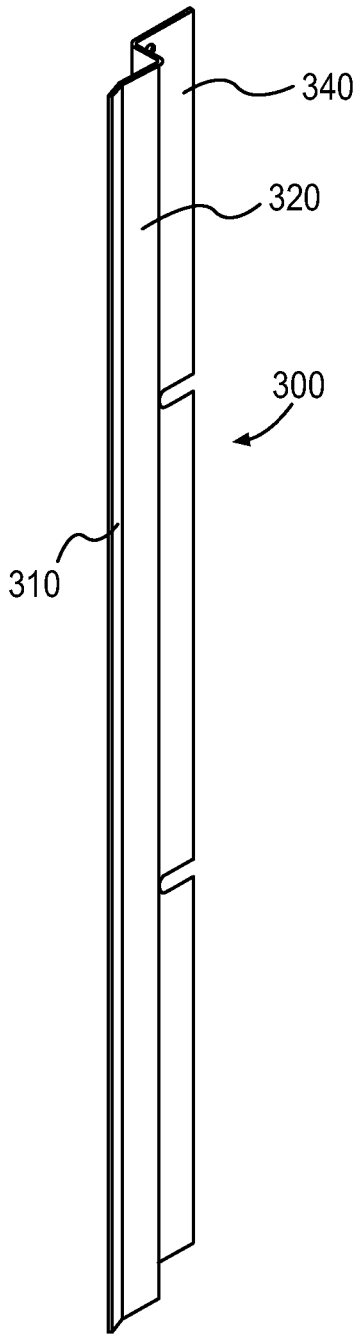
FIG. 10 is a perspective view of an exemplary first mounting bracket in accordance with embodiments of the invention.

FIG. 3 shows side wall trim 200 in a transparent view so that its interaction with large mounting bracket 300 and small mounting bracket 400 can be seen. As can be seen in FIGS. 3 and 4, in this example, large mounting bracket 300 has a generally Z-shaped cross-section. Large mounting bracket 300 has a flat section 340, a flat section 330 at a right angle to section 340, a flat section 320 at a right angle to section 330, and an angled section 310. Large mounting bracket 300 also has, in this example, three slots 350, one or more of which receive a tab 260 that is a part of side wall trim 200. Small mounting bracket 400 has a flat section 410, a flat section 420 at a right angle to section 410, and a flat section 430 at a right angle to section 420. At the top of side wall trim 200 in FIG. 3, an attachment member 280 can be seen. Similarly, at the corresponding point at the bottom of side wall trim 200 in FIG. 3, there is another attachment member 280. Although this example provides tabs on side wall trim 200 and slots in large mounting bracket 300, it is noted that side wall trim 200 can include slots and large mounting bracket 300 can include tabs.

Figure 11:
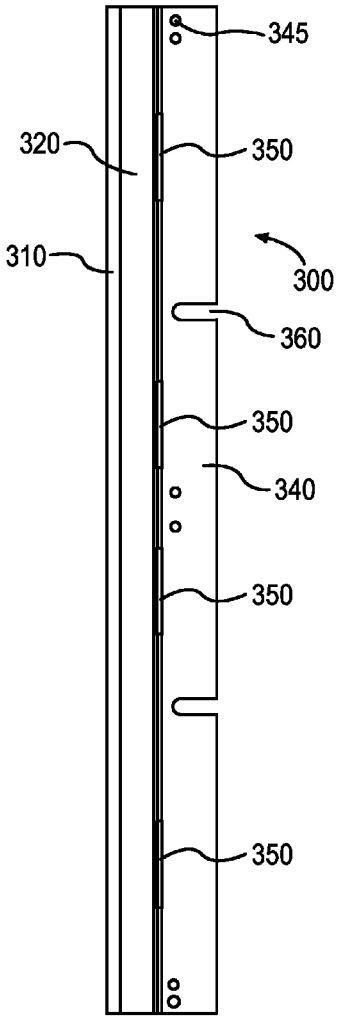
FIG. 11 is a side view of an exemplary first mounting bracket in accordance with embodiments of the invention.
Figure 12:
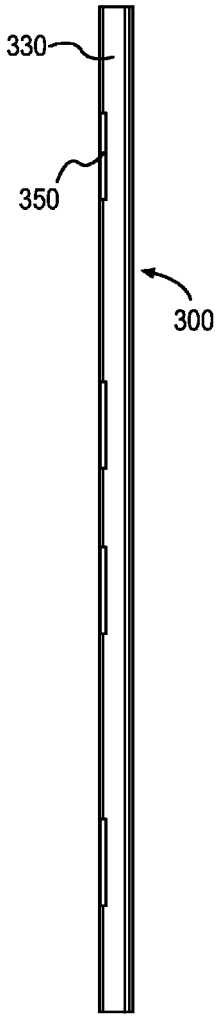
FIG. 12 is a rear view of an exemplary first mounting bracket in accordance with embodiments of the invention.

Large mounting bracket 300 is attached to appliance 100 by, for example, screws, rivets, or other fasteners, through holes 345 and/or slots 360 (shown in FIG. 11). Side wall trim 200 is attached in this example to large mounting bracket 300 by sliding side wall trim 200 from the front of appliance 100 towards the rear of appliance 100 so that tabs 260 engage slots 350. In particular embodiments, the relationship of the distance between section 260 and section 230 relative to the distance between section 340 and section 320 is set so that a friction fit exists between section 260 and section 340 and a friction fit exists between section 230 and section 320, as shown in FIG. 4. This friction fit creates a compression fit that maintains the horizontal position of side wall trim 200 so that there is no movement of side wall trim 200 in the horizontal direction.

After side wall trim 200 is slid into the position shown in FIG. 4, side wall trim 200 is attached at its lower rear end to small mounting bracket 400 by way of one or more screws or other fasteners through hole 290 in attachment member 280 and hole 450 in small mounting bracket 400. Side wall trim 200 is attached at its upper rear end by a screw or other fastener into the appliance outside the zone adjacent to the cooking space. As can be seen in FIG. 4, section 410 of small mounting bracket 400 fits behind attachment member 280 and below, and aligned with, section 270 of side wall trim 200. Small mounting bracket 400 is attached to appliance 100 by way of screws or other fasteners through holes 440 in section 430.

As can be seen in FIG. 3, side wall trim 200, large mounting bracket 300, and small mounting bracket 400 are symmetrical in their design so that they can be used on either side of appliance 100. This universal fit reduces the number of different parts that need to be manufactured and inventoried.

Figure 13:
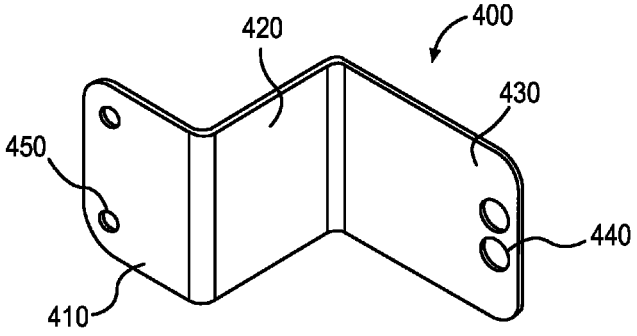
FIG. 13 is a perspective view of an exemplary second mounting bracket in accordance with exemplary embodiments of the invention.

FIGS. 5-8 show an example of side wall trim 200. These Figures show more clearly attachment members 280 and tabs 260. FIGS. 9-12 show an example of large mounting bracket 300. These Figures show more clearly holes 345, slots 350, and slots 360. FIG. 13 shows an example of small mounting bracket 400, FIG. 13 shows more clearly holes 440 and holes 450.

As can be seen in FIG. 1, side wall trim 200 provides a clean and attractive appearance to the side of appliance 100 near the front of appliance 100 with no visible fasteners, while maintaining a secure fit that portrays a high quality product.

In an alternate embodiment, small mounting bracket 400 can be incorporated into side wall trim 200. This embodiment reduces the number of parts associated with the side wall trim system, but, if installed by an installer, would require the installer to attach side wall trim 200 to appliance 100 by use of screws, rivets, or other fasteners. To maintain the universal-fit feature of side wall trim 200, a small mounting bracket 400 would be incorporated at both the top and the bottom of side wall trim 200. In this embodiment, side wall trim 200 is still symmetrical so that it can be used on either side of the appliance.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the invention.

What is claimed is:

1. A domestic cooking appliance, comprising:

a cooking space for cooking a food item;

a left side, a right side, a front and a back, the left and right sides of the domestic cooking appliance having a zone adjacent to the cooking space which is horizontally next to the cooking space;

a heating device for heating the cooking space;

a door for closing off the cooking space;

a first mounting bracket attached to the domestic cooking appliance, the first mounting bracket being of a universal configuration such that it can be attached to either the left side of the domestic cooking appliance or the right side of the domestic cooking appliance outside of the zone adjacent to the cooking space;

a side trim panel attached to the first mounting bracket and the domestic cooking appliance, the side trim panel being of a universal configuration such that it can be attached to the first mounting bracket and the domestic cooking appliance when the first mounting bracket is attached to either the left side of the domestic cooking appliance or the right side of the domestic cooking appliance, the side trim panel attaching to the first mounting bracket by a friction fit;

a second mounting bracket attached to the domestic cooking appliance outside the zone adjacent to the cooking space, the second mounting bracket being of a universal configuration such that it can be attached to either the left side of the domestic cooking appliance or the right side of the domestic cooking appliance, wherein where the side trim panel attaches directly to the domestic cooking appliance, it only attaches to the domestic cooking appliance outside of the zone adjacent to the cooking space, and the side trim panel is attached to the second mounting bracket when the side trim panel is in a fully installed position.

2. The domestic cooking appliance of claim 1, wherein the side trim panel covers less than an entire left side of the domestic cooking appliance.

3. The domestic cooking appliance of claim 1, wherein the side trim panel further comprises one of a slot and a tab, the first mounting bracket further comprises the other of a slot and a tab, and the respective tab engages the respective slot when the side trim panel is attached to the first mounting bracket.

4. The domestic cooking appliance of claim 3, wherein the tab extends horizontally from the side trim panel or first mounting bracket and engages the slot in such a manner that enables the side trim panel to slide from the front of the domestic cooking appliance to the back of the domestic cooking appliance as the tab engages the slot.

5. The domestic cooking appliance of claim 4, wherein the side trim panel includes the tab and further comprises a parallel portion that is parallel to the tab, the first mounting bracket includes the slot and further comprises a first portion and a second portion, the second portion being parallel to the first portion, the slot is located in a third portion of the first mounting bracket that connects the first portion to the second portion, and the tab of the side trim panel presses on the first portion of the first mounting bracket, and the parallel portion of the side trim panel presses on the second portion of the first mounting bracket to create the friction fit.

6. The domestic cooking appliance of claim 3, wherein the side trim panel includes the tab and further comprises a parallel portion that is parallel to the tab, the first mounting bracket includes the slot and further comprises a first portion and a second portion, the second portion being parallel to the first portion, the slot is located in a third portion of the first mounting bracket that connects the first portion to the second portion, and the tab of the side trim panel presses on the first portion of the first mounting bracket, and the parallel portion of the side trim panel presses on the second portion of the first mounting bracket to create the friction fit.

7. The domestic cooking appliance of claim 1, further comprising a second mounting bracket attached to the domestic cooking appliance outside of the zone adjacent to the cooking space.

8. The domestic cooking appliance of claim 7, wherein the side trim panel includes the tab and further comprises a parallel portion that is parallel to the tab, the first mounting bracket includes the slot and further comprises a first portion and a second portion, the second portion being parallel to the first portion, the slot is located in a third portion of the first mounting bracket that connects the first portion to the second portion, and the tab of the side trim panel presses on the first portion of the first mounting bracket, and the parallel portion of the side trim panel presses on the second portion of the first mounting bracket to create the friction fit.

9. The domestic cooking appliance of claim 8, wherein a connecting portion of the side trim panel is attached to a connecting portion of the second mounting bracket, the connecting portion of the second mounting bracket being parallel to the side of the domestic cooking appliance.

10. A side trim panel system for a domestic cooking appliance having a cooking space, a left side, a right side, a front and a back, the left and right sides of the domestic cooking appliance having a zone adjacent to the cooking space which is horizontally next to the cooking space, the system comprising:

a first mounting bracket configured to attach to the domestic cooking appliance, the first mounting bracket being of a universal configuration such that it can be attached to either the left side of the domestic cooking appliance or the right side of the domestic cooking appliance outside of the zone adjacent to the cooking space;

a side trim panel that attaches to the first mounting bracket and the domestic cooking appliance, the side trim panel being of a universal configuration such that it can be attached to the first mounting bracket and the domestic cooking appliance when the first mounting bracket is attached to either the left side of the domestic cooking appliance or the right side of the domestic cooking appliance; and a second mounting bracket configured to attach to the domestic cooking appliance outside the zone adjacent to the cooking space, the second mounting bracket being of a universal configuration such that it can be attached to either the left side of the domestic cooking appliance or the right side of the domestic cooking appliance, wherein the side trim panel attaches to the first mounting bracket by a friction fit, where the side trim panel attaches directly to the domestic cooking appliance, it only attaches to the domestic cooking appliance outside of the zone adjacent to the cooking space, and the side trim panel is attached to the second mounting bracket when the side trim panel is in a fully installed position.

11. The system of claim 10, wherein the side trim panel covers less than an entire side of the domestic cooking appliance.

12. The system of claim 10, wherein the side trim panel further comprises one of a slot and a tab, the first mounting bracket further comprises the other of a slot and a tab, and the tab engages the slot when the side trim panel is attached to the first mounting bracket.

13. The system of claim 12, wherein the tab extends horizontally from the side trim panel or the first mounting bracket and engages the slot in such a manner that enables the side trim panel to slide from the front of the domestic cooking appliance to the back of the domestic cooking appliance as the tab engages the slot.

14. The system of claim 13, wherein the side trim panel includes the tab and further comprises a parallel portion that is parallel to the tab, the first mounting bracket further comprises a first portion and a second portion that is parallel to the first portion, the slot is located in a third portion of the first mounting bracket that connects the first portion and the second portion, and the tab presses on the first portion, and the parallel portion presses on the second portion to create the friction fit.

15. The system of claim 10, wherein the side trim panel further comprises one of a slot and a tab, the first mounting bracket further comprises the other of a slot and a tab, and the tab engages the slot when the side trim panel is attached to the first mounting bracket.

16. The system of claim 15, wherein the side trim panel includes the tab and further comprises a parallel portion that is parallel to the tab, the first mounting bracket further comprises a first portion and a second portion that is parallel to the first portion, the slot is located in a third portion of the first mounting bracket that connects the first portion and the second portion, and the tab presses on the first portion, and the parallel portion presses on the second portion to create the friction fit.

17. The system of claim 16, wherein a connecting portion of the side trim panel is attached to a connecting portion of the second mounting bracket, the connecting portion of the second mounting bracket being parallel to the side of the domestic cooking appliance.

18. A domestic cooking appliance, comprising:

a cooking space for cooking a food item;

a left side, a right side, a front and a back, the left and right sides of the domestic cooking appliance having a zone adjacent to the cooking space which is horizontally next to the cooking space;

a heating device for heating the cooking space;

a door for closing off the cooking space;

a left side first mounting bracket attached to the left side of the domestic cooking appliance outside of the zone adjacent to the cooking space;

a left side trim panel attached to the left side first mounting bracket and the left side of the domestic cooking appliance, the left side trim panel attaching to the left side first mounting bracket by a friction fit;

a right side first mounting bracket attached to the right side of the domestic cooking appliance outside of the zone adjacent to the cooking space; and a right side trim panel attached to the right side first mounting bracket and the right side of the domestic cooking appliance, the right side trim panel attaching to the right side first mounting bracket by a friction fit;

a left side second mounting bracket attached to the left side of the domestic cooking appliance outside of the zone adjacent to the cooking space; and a right side second mounting bracket attached to the right side of the domestic cooking appliance outside of the zone adjacent to the cooking space, wherein where the left side trim panel attaches directly to the domestic cooking appliance, it only attaches to the domestic cooking appliance outside of the zone adjacent to the cooking space, where the right side trim panel attaches directly to the domestic cooking appliance, it only attaches to the domestic cooking appliance outside of the zone adjacent to the cooking space, the left side first mounting bracket and the right side first mounting bracket are identical, the left side trim panel and the right side trim panel are identical, the left side second mounting bracket and the right side second mounting bracket are identical, and each respective side trim panel is attached to the respective second mounting bracket when the respective side trim panel is in a fully installed position.

19. The domestic cooking appliance of claim 18, wherein each of the left side trim panel and the right side trim panel further comprises one of a slot and a tab, each of the left side first mounting bracket and the right side first mounting bracket further comprises the other of a slot and a tab, the respective tab engages the respective slot when the respective side trim panel is attached to the respective first mounting bracket, and each tab extends horizontally from the respective side trim panel or first mounting bracket and engages the respective slot in such a manner that enables the respective side trim panel to slide from the front of the domestic cooking appliance to the back of the domestic cooking appliance as the respective tab engages the respective slot.

20. The domestic cooking appliance of claim 19, wherein each respective side trim panel includes the respective tab and further comprises a parallel portion that is parallel to the tab of the respective side trim panel, each respective first mounting bracket includes the respective slot and further comprises a first portion and a second portion, the second portion being parallel to the first portion, the slot of the respective first mounting bracket is located in a third portion of the respective first mounting bracket that connects the first portion to the second portion, and the tab of the respective side trim panel presses on the first portion of the respective first mounting bracket, and the parallel portion of the respective side trim panel presses on the second portion of the respective first mounting bracket to create the friction fit.

* * * * *